US008596327B2

(12) United States Patent
Rupel

(10) Patent No.: US 8,596,327 B2
(45) Date of Patent: Dec. 3, 2013

(54) COLLAPSIBLE SHADE CONTAINING A SHEER FABRIC

(75) Inventor: John D. Rupel, Pine River, WI (US)

(73) Assignee: Hunter Douglas, Inc., Upper Saddle River, NJ (US)

( * ) Notice: Subject to any disclaimer, the term of this patent is extended or adjusted under 35 U.S.C. 154(b) by 0 days.

(21) Appl. No.: 13/150,747

(22) Filed: Jun. 1, 2011

(65) Prior Publication Data

US 2011/0297332 A1 Dec. 8, 2011

Related U.S. Application Data

(60) Provisional application No. 61/350,768, filed on Jun. 2, 2010.

(51) Int. Cl.
*A47H 5/00* (2006.01)

(52) U.S. Cl.
USPC ..... 160/84.05; 160/84.04

(58) Field of Classification Search
USPC ..... 160/84.05, 84.04, 115, 84.01, 84.03; 156/65, 197; 442/149, 150, 151; 428/116
See application file for complete search history.

(56) References Cited

U.S. PATENT DOCUMENTS 4,631,217 A * 12/1986 Anderson ..... 428/118
4,685,986 A * 8/1987 Anderson ..... 156/197
4,861,404 A * 8/1989 Neff ..... 156/204
4,882,211 A * 11/1989 McIntyre et al. ..... 428/41.6
4,884,612 A * 12/1989 Schnebly et al. ..... 160/84.04
5,043,039 A * 8/1991 Swiszcz ..... 156/197
5,129,440 A * 7/1992 Colson ..... 160/84.02
5,205,333 A * 4/1993 Judkins ..... 160/84.02
5,425,408 A * 6/1995 Colson ..... 160/84.07
5,503,210 A * 4/1996 Colson et al. ..... 160/84.05
5,547,006 A * 8/1996 Auger ..... 160/84.01
5,701,940 A * 12/1997 Ford et al. ..... 160/84.05
5,746,266 A * 5/1998 Colson et al. ..... 160/84.05
5,874,144 A * 2/1999 Kumar et al. ..... 428/40.1
5,914,165 A * 6/1999 Freedman ..... 428/40.1
6,196,291 B1 * 3/2001 Rupel et al. ..... 160/84.05
6,982,020 B2 * 1/2006 Swiszcz et al. ..... 156/203
6,982,108 B2 * 1/2006 Janssen et al. ..... 428/42.1
7,074,475 B2 * 7/2006 Yu ..... 428/116
7,159,634 B1 * 1/2007 Judkins ..... 160/84.05
7,273,529 B2 * 9/2007 Judkins et al. ..... 156/65

(Continued)

OTHER PUBLICATIONS

Dynlab Corp. "Plastic Properties of Polypropylene (PP)". Accessed Apr. 17, 2012. http://www.dynalabcorp.com/technical_info_polypropylene.asp.*

*Primary Examiner* — Katherine Mitchell
*Assistant Examiner* — Johnnie A Shablack
(74) *Attorney, Agent, or Firm* — Dority & Manning, P.A.

(57) ABSTRACT

A shade product is described that is made at least in part with a sheer material. Sheer materials are highly porous materials that allow significant amounts of light to pass through the material. When placed in an architectural opening, such as a window, sheer materials can provide a soft and elegant appearance while still providing privacy. When using sheer materials to construct shade products, one layer of the sheer material typically needs to be bonded to an adjacent material, such as another layer of the sheer material. In accordance with the present disclosure, an adhesive receptive coating is applied to the sheer material at the bond sites in order to prevent against adhesive migration. In one embodiment, the adhesive receptive coating is substantially transparent and therefore does not interfere with the overall look and aesthetic appeal of the product.

25 Claims, 8 Drawing Sheets

(56) References Cited

U.S. PATENT DOCUMENTS

| | | | | |
|---|---|---|---|---|
| 7,513,292 | B2 * | 4/2009 | Auger et al. | 160/84.05 |
| 7,588,068 | B2 * | 9/2009 | Colson et al. | 160/121.1 |
| 7,637,301 | B2 * | 12/2009 | Forst Randle | 160/121.1 |
| 7,779,881 | B2 * | 8/2010 | Judkins et al. | 156/361 |
| 7,984,743 | B2 * | 7/2011 | Rossato | 160/84.05 |
| 8,220,518 | B2 * | 7/2012 | Judkins | 160/84.05 |
| 2004/0013839 | A1 * | 1/2004 | Ko et al. | 428/40.1 |
| 2005/0112317 | A1 * | 5/2005 | McCarthy et al. | 428/42.2 |
| 2006/0046005 | A1 * | 3/2006 | McGee | 428/34.4 |
| 2006/0062947 | A1 * | 3/2006 | Huffer et al. | 428/34.2 |
| 2006/0174999 | A1 * | 8/2006 | Rupel et al. | 156/197 |
| 2009/0263637 | A1 * | 10/2009 | Smith et al. | 428/212 |
| 2009/0266496 | A1 * | 10/2009 | Dann et al. | 160/84.05 |
| 2012/0077399 | A1 * | 3/2012 | Yagura et al. | 442/65 |

* cited by examiner

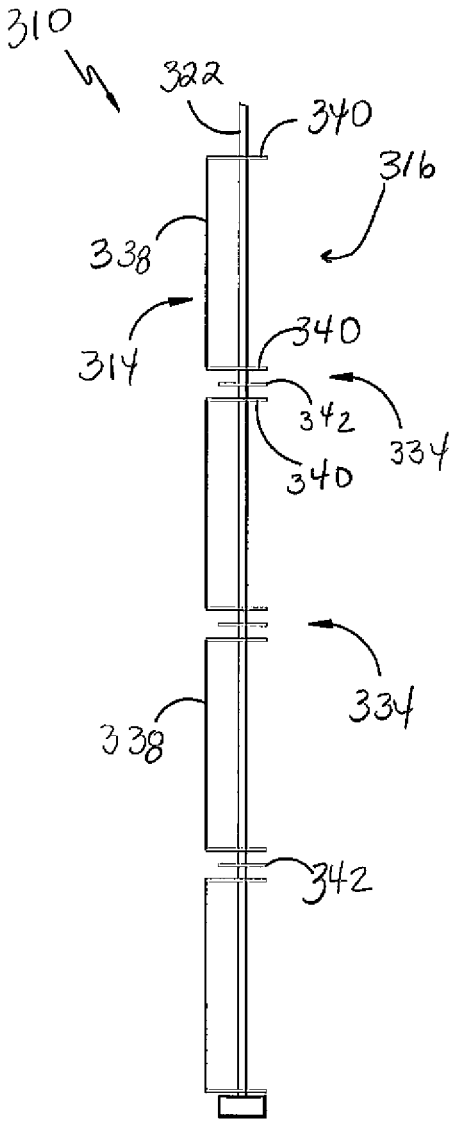
FIG. —9—
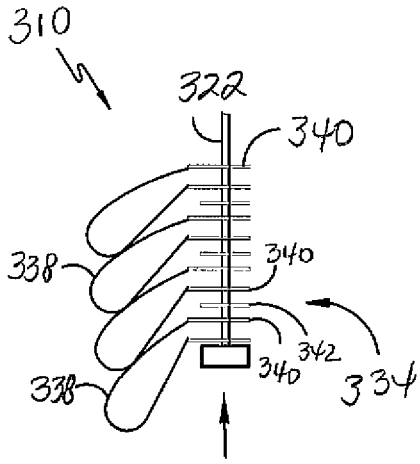
FIG. —10—

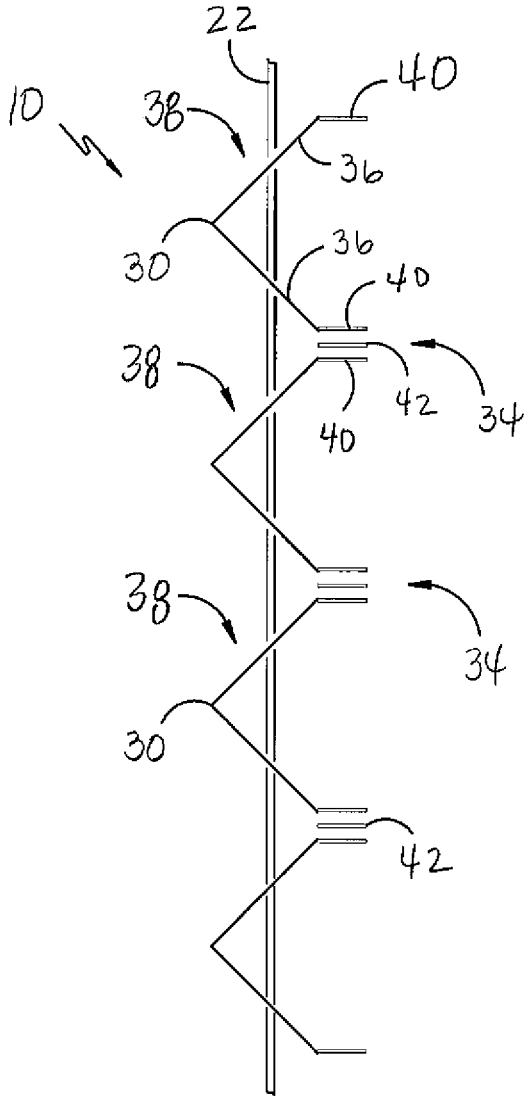
FIG. –11–

COLLAPSIBLE SHADE CONTAINING A SHEER FABRIC

RELATED APPLICATIONS

The present application is based upon and claims priority to U.S. Provisional Patent Application No, 61/350,768 filed on Jun. 2, 2010, which is incorporated herein by reference.

BACKGROUND

Various different coverings exist for architectural openings such as doors, windows and the like. The coverings, for instance, can provide privacy, can provide thermal insulation, and/or can be aesthetically pleasing. One type of covering is referred to as a shade. Although shades can take many different forms, shades typically include a fabric that is designed to be suspended adjacent to the top of an architectural opening by hardware that may be capable of raising and lowering the fabric.

The fabric can be configured to be raised and lowered in numerous ways. For instance, roller shades typically include a shade material that winds and unwinds on a rotating mandrel for retracting and extending the shade. Other shades include Roman shades that hang flat when lowered and pleated shades that include horizontal fold lines that allow the shade to collapse into a uniform stack when retracted. Another type of shade is typically referred to as a cellular shade. Cellular shades are made from a series of connected foldable cells.

One of the advantages to installing a shade within an architectural opening is the ability to select a shade material or fabric that lets a desired amount of light to pass through the shade. For instance, in one embodiment, a shade material may be selected that completely blocks light from entering through the architectural opening. In an alternative embodiment, a shade material may be selected that allows a small amount of light to pass through the material for allowing some light to enter through the architectural opening while also providing visual appeal. In still another embodiment, a shade material may be selected that allows a substantial amount of light to pass through the architectural opening. Such materials are typically referred to as "sheer" materials. Sheer materials, for instance, can be made with a relatively open weave and can be constructed from woven or knit monofilament yarns.

Although sheer materials are highly desirable in some applications, the use of sheer materials has created various problems for shade manufacturers. For example, many types of shades are made from multiple pieces of material. The multiple pieces of material are typically connected together to form the shade through the use of an adhesive, such as a liquid adhesive. Beads of adhesive, for instance, are typically used not only to construct individual cells in a cellular shape, but also typically used to interconnect the cells together. Unfortunately, however, such adhesives have a tendency to penetrate through highly porous materials, such as sheer materials. Not only can the adhesive be unsightly with respect to such materials, but adhesive migration can also cause unintended parts of the shade material to bond together creating an unusable product.

In view of the above problems, those skilled in the art have proposed various different methods and techniques for bonding together sheer materials when constructing shade products. For instance, U.S. Pat. No. 4,673,600 discloses cellular shades made from sheer materials wherein the sheer materials are bonded by allowing the adhesive to cure while the cells are in an expanded state.

U.S. Pat. No. 5,043,039 also discloses a method for forming cellular shades using a sheer material. In the '039 patent, strips of a non-bonding material are placed at selected locations within a cellular shade during application of an adhesive in order to prevent the adhesive from bonding unintended parts of the shade together. When the adhesive has set, the non-bonding strips are then removed from the product.

The present disclosure is directed to further improvements in shade products containing sheer materials. More particularly, the present disclosure is directed to further improvements in controlling adhesive migration through porous materials, such as sheer materials during the production of shade products.

SUMMARY

The present disclosure is generally directed to a shade product including a fabric panel at least partially made from a sheer material. As used herein, a "sheer material" refers to any porous material that is suitable for use as a shade material and allows substantial amounts of light transmission or is at least partially transparent or translucent. The present disclosure is more particularly directed to a method for bonding the sheer material to itself or to another material while preventing adhesive migration.

In one embodiment, for instance, the present disclosure is directed to a vertically expandable and collapsible shade capable of being raised and lowered. The shade includes a fabric panel comprised of a sheer material. The fabric panel includes at least one bond site where the sheer material has been bonded to an adjacent material. The sheer material at each bond site includes an adhesive receptive coating. The adhesive receptive coating can comprise a continuous polymer coating that prevents an adhesive from migrating through the sheer material by blocking or 'plugging' the interstitial openings in the fabric material.

An adhesive is located at the bond site that adheres the sheer material to the adjacent material. In one embodiment, for instance, the adhesive may be used to adhere one layer of the sheer material to an adjacent layer of the sheer material. In this embodiment, the adhesive receptive coating can be applied to both layers of the sheer material. The adhesive can then be located in between the adhesive receptive coatings for attaching the two layers together without having the adhesive bond to unintended parts of the shade.

The adhesive receptive coating of the present disclosure can be made from various materials. In one embodiment, for instance, the adhesive receptive coating may comprise a varnish. In one particular embodiment, the adhesive receptive coating may be made from a UV (ultraviolet) cured polymer. The polymer coating, for example, may comprise an epoxy-acrylic resin.

In an alternative embodiment, the adhesive receptive coating may comprise a hot melt adhesive. The hot melt adhesive may have a relatively high softening temperature. For instance, the polymer contained in the hot melt adhesive may have a softening temperature of greater than about 180° C., such as greater than about 190° C., such as greater than about 200° C. The hot melt adhesive, for instance, may contain a polyester or co-polyester polymer and/or a polyamide polymer and/or polyurethane polymer.

In one embodiment, the adhesive receptive coating, once applied to the sheer material, may be substantially transparent. By using a substantially transparent coating, the adhesive receptive coating becomes virtually unnoticeable in the final product.

In an alternative embodiment, the adhesive receptive coating may have a color that substantially matches the color of the sheer material for making the coating less noticeable or unnoticeable. For example, in one embodiment, the adhesive receptive coating and the sheer material may have a substantially white color. For instance, many hot melt adhesives as described above generally have a white or off-white color once cooled to room temperature. A sheer material can be selected that matches this color.

The shade product made according to the present disclosure can have any suitable configuration. For instance, in one embodiment, the fabric panel can be made primarily from the sheer material and can include a plurality of parallel crease lines. For instance, in one embodiment, adjacent crease lines can extend or project in opposite directions for producing an overall accordion-like configuration. In this manner, when the shade is retracted, the fabric panel folds upon itself in an orderly manner producing a stack having minimal thickness. In one embodiment, bond sites can be located where two layers of the sheer material are attached together by an adhesive to form, for example, tabs. The tabs, for instance, may be configured to hold a drawstring that raises and lowers the shade.

The adhesive receptive coating may comprise strips that extend parallel to the crease lines. The strips can be positioned on opposing layers of the sheer material where the bond sites are located such that the adhesive is located between the opposing strips. In forming tabs as described above, the tabs can be formed by folding the sheer material over onto itself and adhering the two layers together or can be formed by attaching two separate pieces of the sheer material together.

In order to vertically raise and lower the collapsible shade, in one embodiment, the shade product may include at least one drawstring. The drawstring may be connected to the shade product by intersecting the tabs. Alternatively, the drawstring may intersect the sheer material inbetween adjacent crease lines.

In an alternative embodiment, instead of having an accordion-like configuration as described above, the fabric panel may be comprised of individual cells to form a cellular shade. For instance, the cells can be consecutively attached together and can be configured to assume a flat folded configuration when the shade is retracted and an open cell configuration when the shade is extended. The cells can be made from a sheer material and can include bond sites not only located within each cell but can also include bond sites located between adjacent cells. In accordance with the present disclosure, the adhesive receptive coating can be applied to opposing layers of the sheer material where the bond sites are located for preventing adhesive migration.

In still another embodiment, the shade product may be in the form of a Roman shade. The Roman shade may include a plurality of fabric sections that are attached together using bond sites as described above. The fabric sections may be free of any crease lines inbetween the bond sites. Thus, when the shade is retracted, the fabric sections may overlap and billow.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which:

FIG. 9 is a partial exploded side view of another embodiment of a shade product made in accordance with the present disclosure;

FIG. 10 is a partial exploded side view of the embodiment illustrated in FIG. 9 illustrating the shade product in a retracted state; and FIG. 11 is a partial exploded side view of another embodiment of a shade product made in accordance with the present disclosure.

Figure 1:
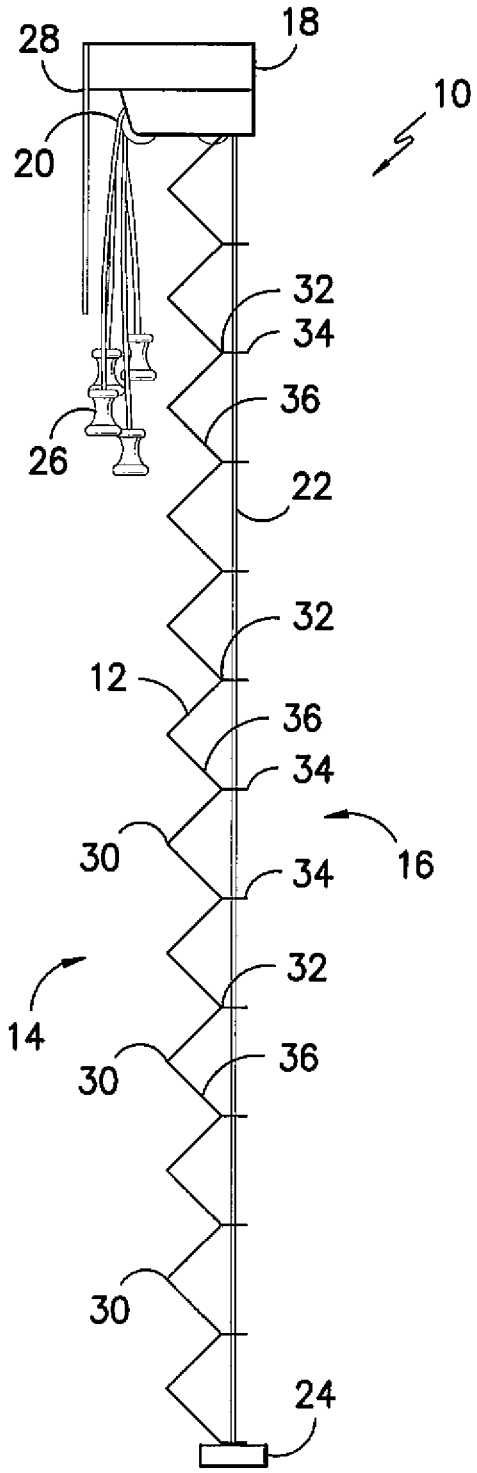
FIG. 1 is a side view of one embodiment of a shade product made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to an expandable and collapsible shade that includes a fabric panel at least partially made from a sheer material. The use of sheer materials in shade products is highly desirable in some applications. Sheer materials, for instance, allow significant amounts of light to pass through the material while still providing the interior of a home or building with some privacy. When exposed to direct sunlight, for instance, sheer materials have a tendency to "glow" providing the room with a distinctive amount of lighting that ultimately makes the room feel more inviting and comfortable.

As described above, however, problems have been experienced in the past in constructing shade products containing a sheer material. In constructing a shade, for instance, the fabric panel typically needs to be glued or adhered together at certain locations, especially when constructing a cellular product. Adhesives, however, have a tendency to migrate through sheer materials which can damage the product and/or adversely affect the appearance of the shade material. In view of the above, the present disclosure is directed to further improvements in shade products containing sheer materials. According to the present disclosure, an adhesive receptive coating is applied to the sheer material where the material is to be bonded or adhered to an adjacent material. The adhesive receptive coating prevents adhesive migration without adversely affecting the appearance of the shade product.

One embodiment of a vertically expandable and collapsible shade made in accordance with the present disclosure is illustrated in FIG. 1. As shown, the shade product 10 includes a fabric panel 12 that includes a first side 14 and an opposite side 16. The shade product 10 is configured to be mounted within an architectural opening, such as a window or door. In the embodiment illustrated in FIG. 1, the first side 14 of the shade product 10 is intended to face the interior of the building, home or dwelling. The second and opposite side 16, on the other hand, is intended to face towards the exterior of the building or home. The second side 16 is configured to face a window, for example, if the shade product 10 is to be installed adjacent to the window.

The shade product 10 includes a head rail 18. The head rail 18 can have a number of functions. For instance, the head rail 18 can be associated with various mounting members, such as mounting brackets that allow for the shade product 10 to be mounted or affixed within an architectural opening. In one embodiment, for instance, two opposing brackets can be mounted within the architectural opening and the head rail 18 can, in turn, be attached to the brackets.

The head rail 18 can also include a mechanism 20 for vertically raising and lowering the fabric panel 12. For instance, as shown in FIG. 1, the shade product 10 can include one or more drawstrings 22. The drawstring 22 can be engaged or connected with the fabric panel 12 at regular intervals and attached to a footer 24. Opposite the footer, the drawstring 22 can engage one or more pulleys and can terminate with one or more handles 26. The handles 26 can be configured to be grasped by a user and pulled in a downward motion for retracting the fabric panel 12. The control mechanism 20 can further include a stop device that can be configured to engage the drawstring 22 for locking the drawstring at a particular position. For instance, the stop device can be used to hold the fabric panel 12 in a fully retracted position or in any position between fully retracted and fully extended. The stop device can be engageable and disengageable by pulling the drawstring in a certain direction.

As shown in FIG. 1, the shade product 10 can include multiple drawstrings depending upon the width of the fabric panel. Multiple drawstrings may help keep the fabric panel in alignment when the shade product is retracted or extended. Multiple drawstrings can also provide greater strength and increase the wear life of the product.

In the embodiment illustrated in FIG. 1, the control mechanism for raising and lowering the fabric panel 12 comprises a manual system. In other embodiments, however, the shade product 10 may include a motor, such as an electric motor, for raising and lowering the fabric panel.

In order to conceal the head rail 18 and the control mechanism 20, the shade product 10 can include a decorative panel 28. The decorative panel may be configured to only conceal the head rail or may extend downwardly such as in the embodiment shown in FIG. 1. In FIG. 1, the decorative panel can have a length sufficient to conceal the fabric panel 12 when fully retracted.

As shown in FIG. 1, the fabric panel 12 includes a plurality of alternating crease lines 30 and 32. The crease lines 30 and 32 are generally parallel with each other and extend in a horizontal direction or across the width of the fabric panel. As shown, the crease lines 30 generally extend or project towards the first front side 14, while the crease lines 32 extend towards the second or back side 16 of the fabric panel 12. In this manner, the fabric panel 12 has a "zig-zag" side profile that results in an accordion-like configuration. In particular, in between each crease line 30 and 32 extends a fabric segment 36. When the fabric panel 12 is retracted by the drawstring 22, the fabric segments 36 fold on top of one another to form a stack due to the presence of the opposing crease lines 30 and 32.

As shown in FIG. 1, each crease line 32 facing the second side 16 of the fabric panel 12 forms a tab 34. The plurality of tabs 34 are engaged with or connected to one or more drawstrings 22. The tabs 34 are formed by attaching together with an adhesive two layers of material that are used to form the fabric panel 12.

In accordance with the present disclosure, the fabric panel 12 is comprised of a sheer material. The sheer material, for instance, can be a highly porous material that allows light, such as sunlight, to pass through the material for providing not only a distinctive look when placed in an architectural opening, but also can deliver a desired amount of light to a room while also providing some privacy. In one embodiment, the sheer material can comprise a woven material, a knit material or a non-woven material. The material, for instance, may have an open weave or open knit construction or may be apertured. In one particular embodiment, the sheer material may be made from monofilament synthetic yarns and/or fibers.

One problem with such materials, however, is that in order to bond the material to an adjacent material, an adhesive typically penetrates the sheer material so that at least certain fibers are embedded within the adhesive. Unfortunately, however, adhesive materials have a tendency to migrate completely through the fabric which may cause unintended parts of the fabric panel to bond together.

In accordance with the present disclosure, an adhesive receptive coating is applied to the sheer material at bond sites where the sheer material is to be adhered to an adjacent material. For instance, in constructing the tabs 34, an adhesive receptive coating can be first applied to the sheer material where the tabs 34 are to be created. Once the adhesive receptive coating is applied to the sheer material, an adhesive can be applied in between the coatings for adhering the sheer material together in forming the tabs 34.

Figure 3:
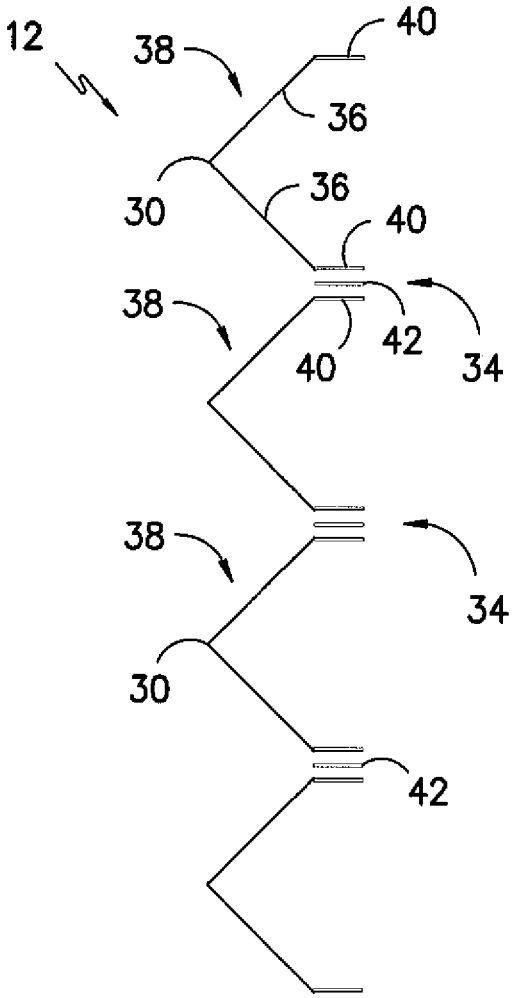
FIG. 3 is a partial exploded view of the shade product illustrated in FIG. 1.

Referring to FIG. 3, for instance, one embodiment of a method for forming the fabric panel 12 as shown in FIG. 1 is illustrated. In this embodiment, the fabric panel 12 is formed of a plurality of fabric sections 38. Each fabric section 38 is comprised of two fabric segments 36 separated by a corresponding crease line 30.

In accordance with the present disclosure, each end of each fabric section 38 includes an adhesive receptive coating 40. The adhesive receptive coating 40 is in the shape of a continuous strip that extends substantially the entire width of the fabric section 38. By applying an adhesive receptive coating 40 at each end of each fabric section 38, an adhesive 42 can be placed in between adjacent coatings for forming the tabs 34. As described above, the adhesive receptive coatings 40 prevent adhesive migration without interfering with the ability of the adhesive to bond the two pieces of material together.

The adhesive receptive coatings 40 are generally made from a polymer material. In one embodiment, for instance, a polymer material can be selected that is substantially transparent. By selecting a substantially transparent material, the adhesive receptive coatings 40 do not distract from the appearance of the fabric panel 12.

In an alternative embodiment, the adhesive receptive coatings 40 may be colored or pigmented to match or coordinate with the color of the fabric panel 12. For example, in one embodiment, the adhesive receptive coatings 40 may have a color that is substantially the same as the color of the fabric panel. In another embodiment, the adhesive receptive coatings 40 may generally have the same color as the fabric panel but may have a lighter or darker shade in order to improve the overall appearance of the product. In yet another embodiment, the adhesive receptive coatings 40 may have a color that does not match the color of the fabric panel but may have a color that is complimentary to the color of the fabric panel. Complimentary colors are pairs of colors that are of opposite hue (i.e. on opposite sides of the color wheel).

In one embodiment, the adhesive receptive coatings 40 are made from a varnish which, in one embodiment, may be cured by the application of ultraviolet light. In one particular embodiment, for instance, the adhesive receptive coating 40 may be made from a UV curable acrylic resin. The acrylic resin, for instance, may contain an epoxy-acrylic resin in combination with at least one acrylate, such as a multifunctional acrylate.

In one particular embodiment, the adhesive receptive coating 40 is formed from a UV curable doming compound. For instance, in one embodiment, the coating is formed from a product sold under the trade name RAD-KOTE, such as product number 307SPTF2, which is available from Actega Coatings and Sealants.

In an alternative embodiment, instead of using a UV curable resin, the adhesive receptive coating 40 may be formed from a hot melt adhesive. The hot melt adhesive, for instance, may comprise a polyolefin, such as a polyethylene or a polypropylene, a polyester, a polyvinyl chloride, a copolymer thereof, or the like. In one embodiment, the hot melt adhesive has a relatively high softening temperature so as to ensure that the hot melt adhesive is capable of withstanding exposure to direct sunlight. For instance, in one embodiment, the hot melt adhesive may have a softening temperature of greater than about 170° C., such as greater than about 180° C., such as even greater than about 200° C. The softening temperature of the hot melt adhesive, for instance, may range in one embodiment from about 200° C. to about 240° C.

In one particular embodiment, the hot melt adhesive may comprise a linear, saturated copolyester resin. Such products, for instance, are sold under the name VITEL by Bostik Adhesives.

In one particular embodiment, a hot melt adhesive is used as the adhesive receptive coating and applied to a substantially white sheer material. Many hot melt adhesives, for instance, when dried, exhibit a substantially white color. By applying a hot melt adhesive to a substantially white sheer material, the adhesive receptive coating becomes very difficult to discern.

The thickness of the adhesive receptive coating 40 applied to the sheer material may vary depending upon various factors, including the type of polymer that is used to form the coating. In one embodiment, for instance, the adhesive receptive coating may have a thickness of less than about 5 mils. For instance, in one embodiment, the coating can have a thickness of from about 0.5 mils to about 3 mils.

Figure 2:
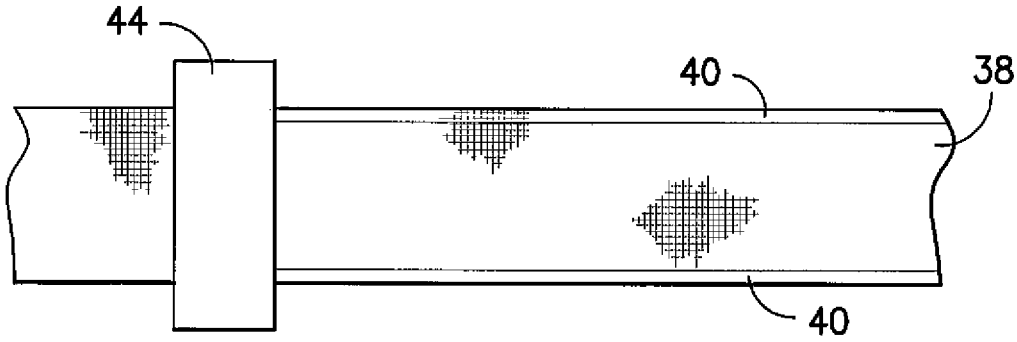
FIG. 2 is a plan view illustrating one method for applying an adhesive receptive coating to a sheer material in accordance with the present disclosure.

The manner by which the adhesive receptive coating is formed on the sheer material can also vary depending upon various factors. In one embodiment, for instance, as shown in FIG. 2, the adhesive receptive coating 40 may be slot coated onto the sheer material, such as the fabric sections 38. In FIG. 2, for example, the fabric section 38 is being shown moving below a slot coating device 44. The slot coating device 44 applies a polymer composition to the sheer fabric in order to form the adhesive receptive coatings 40. Consistent with FIG. 3, in the embodiment illustrated in FIG. 2, the adhesive receptive coatings 40 are being formed at each edge of the fabric section 38. As shown, the adhesive receptive coating 40 is generally continuous where the adhesive is subsequently applied.

In the embodiment illustrated in FIG. 3, the adhesive receptive coating 40 is applied to the side of the fabric section 38 opposite the side of the fabric section to which the adhesive 42 is applied. In an alternative embodiment, however, the adhesive receptive coating 40 may be applied to the same side of the fabric section upon which the adhesive 42 is applied.

In addition to forming the adhesive receptive coatings using a slot coat device, the polymer coatings can also be formed using printing, such as flexographic printing. In still another embodiment, the coating composition can be applied to the sheer material through extrusion, by spraying, or through the use of a rotary screen.

After the coating composition is applied to the sheer material, in some embodiments, the coating composition can be cured. For instance, in one embodiment, the coating composition can be exposed to ultraviolet rays for hardening and curing the coating. The cure energy of the UV light, for instance, can be greater than about 40 $mJ/cm^2$, such as greater than about 50 $mJ/cm^2$.

The adhesive 42 that is applied in between the adhesive receptive coatings 40 can comprise any suitable adhesive. In general, any adhesive may be used in accordance with the present disclosure as long as the adhesive has properties and characteristics that can withstand temperatures and stress to which a typical shade material is exposed. In one embodiment, the adhesive that is applied between the adhesive receptive coatings 40 has a melting point or softening temperature that is lower than the polymer used to form the adhesive receptive coatings. Adhesives that may be used include polyester adhesives, co-polyester adhesives, polyurethane adhesives, polyamide adhesives, pressure sensitive adhesives, adhesives containing an amorphous poly-alpha-olefin, and the like.

In one embodiment, the adhesive 42 may be applied as a bead in between the two coating layers.

In the embodiment illustrated in FIGS. 2 and 3, the different fabric sections 38 are first treated with a polymer composition to form the adhesive receptive coatings. The fabric sections 38 can then be fed to a process during which the creases 30 are formed or created while also creating the tabs 34 by applying the adhesive 42 in between the adhesive receptive coatings 40. In an alternative embodiment, however, the fabric panel 12 may also be formed from a single piece of sheer material. In this embodiment, the tabs 34 can be formed by folding the sheer material over onto itself and creating the crease lines 32. In order to form the tabs where the crease lines are located, adhesive receptive coatings can be applied to opposite surfaces along the crease lines and then adhered together using an adhesive. In this embodiment, a process similar to the one illustrated in FIG. 2 may be used except that the fabric will have a continuous length and the adhesive receptive coatings will be applied in a pattern over the length of material.

Referring to FIG. 11, another embodiment of a shade product made in accordance with the present disclosure is shown. The embodiment illustrated in FIG. 11 is very similar to the embodiment illustrated in FIGS. 1 and 3. Thus, like reference numerals have been used to represent similar elements.

Referring to FIG. 11, the shade product 10 includes a fabric panel formed from a plurality of fabric sections 38. Each fabric section 38 is comprised of two fabric segments 36 separated by a corresponding crease line 30. Each end of each fabric section 38 includes an adhesive receptive coating 40. An adhesive 42 is placed inbetween adjacent coatings for forming tabs 34.

In the embodiment illustrated in FIG. 1, the drawstring 22 intersects each of the tabs 34. In the embodiment illustrated in FIG. 11, on the other hand, a drawstring 22 intersects each fabric segment 36 inbetween the tabs 34 and the crease lines 30. In this manner, the drawstring 22 is more integrated into the product.

Figure 4:
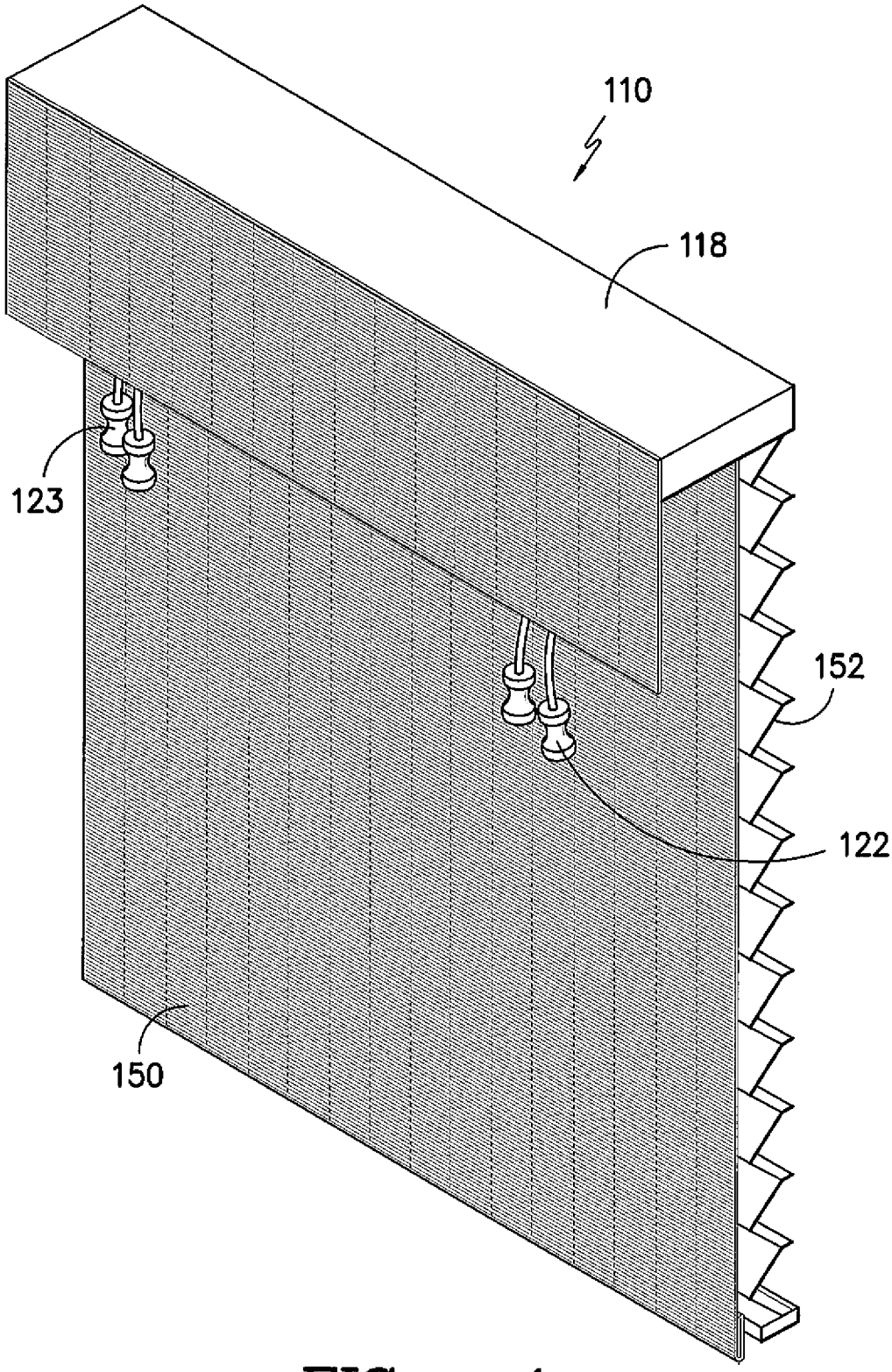
FIG. 4 is an alternative embodiment of a shade product made in accordance with the present disclosure.
Figure 5:
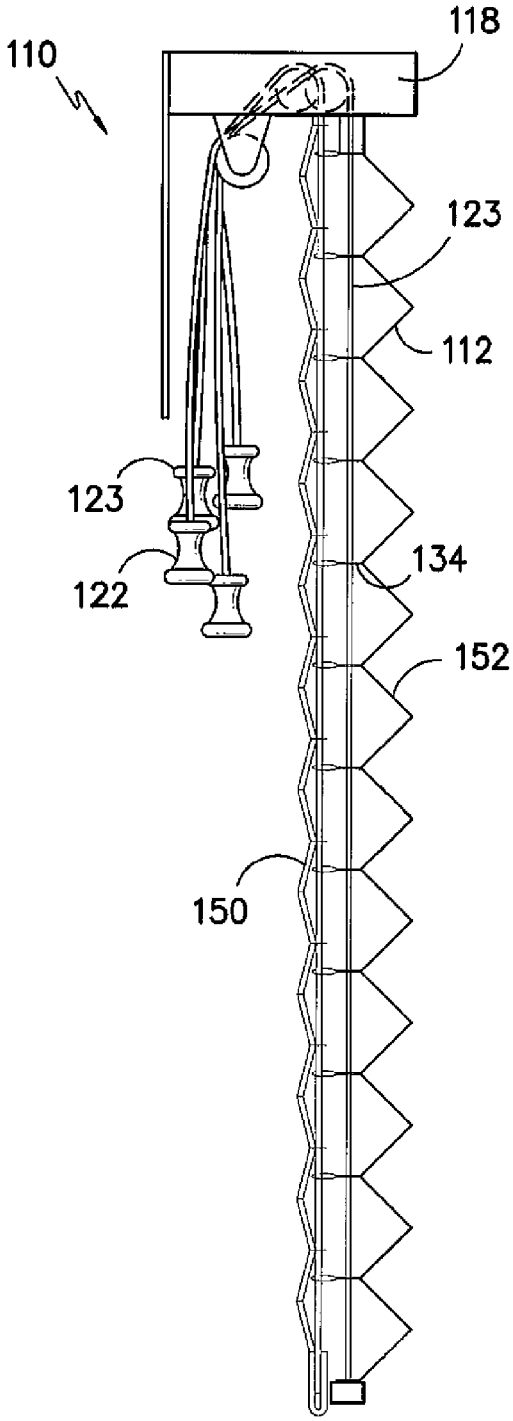
FIG. 5 is a side view of the shade product illustrated in FIG. 4.

Referring now to FIGS. 4 and 5, another embodiment of a shade product generally 110 made in accordance with the present disclosure is shown. The shade product 110 illustrated in FIGS. 4 and 5 is a "dual shade" product in that the shade product includes a front or face shade 150 and a back shade 152. In the embodiment illustrated, the front shade 150 comprises a woven wood material. The woven wood material may be made from, for instance, jute, bamboo, reeds and/or grasses. Woven wood shades not only have a textured appearance but also block most of the sunlight from entering a room.

In the embodiment illustrated in FIG. 5, the front shade comprises a woven wood material. It should be understood, however, that the front shade may comprise any suitable material. For example, the front shade may comprise a woven fabric, a knitted fabric, a non-woven material such as a hydroentangled web, a film, or the like. Further, in an alternative embodiment, the sheer material may be used to construct the front shade, while a fabric with higher opacity and/or a material that lets less amount of light through the material may form the back shade.

The back shade 152, on the other hand, can comprise the shade product and fabric panel as illustrated in FIG. 1. In this regard, the back shade 152 can be made from a sheer material that allows a substantial amount of light to pass through the material. By including the front shade 150 in combination with the back shade 152, a consumer can adjust the fabric panels in relation to each other for allowing the desired amount of light through the shade product for producing a desired effect.

The shade product 110 can include various mechanisms for raising and lowering the front shade 150 and for raising and lowering the back shade 152 independently of each other. For instance, as shown in FIG. 4, the shade product 110 can include a first set of drawstrings 122 for controlling the front shade 150 in addition to the drawstrings 123 that control the back shade 152. The drawstrings 123 and 122 can be threaded through a head rail assembly 118 and then in turn connected to a respective fabric panel.

As shown in FIG. 5, the back shade 152 comprises a fabric panel 112 made from a sheer material. Similar to the embodiment illustrated in FIG. 1, the back fabric panel 152 made from the sheer material can have an accordion-like configuration which allows the fabric panel 112 to fold neatly together when raised or retracted. In accordance with the present disclosure, the fabric panel 112 can also define a plurality of tabs 134 that can be constructed as described above. In particular, the tabs can be formed by applying an adhesive between two adhesive receptive coatings applied to the sheer material.

In the embodiment illustrated in FIG. 5, the drawstring 123 is located in between the back shade and the front shade. In still another embodiment, the back shade may comprise a cellular shade as shown in FIG. 6 in which the drawstring intersects the individual cells.

Figure 6:
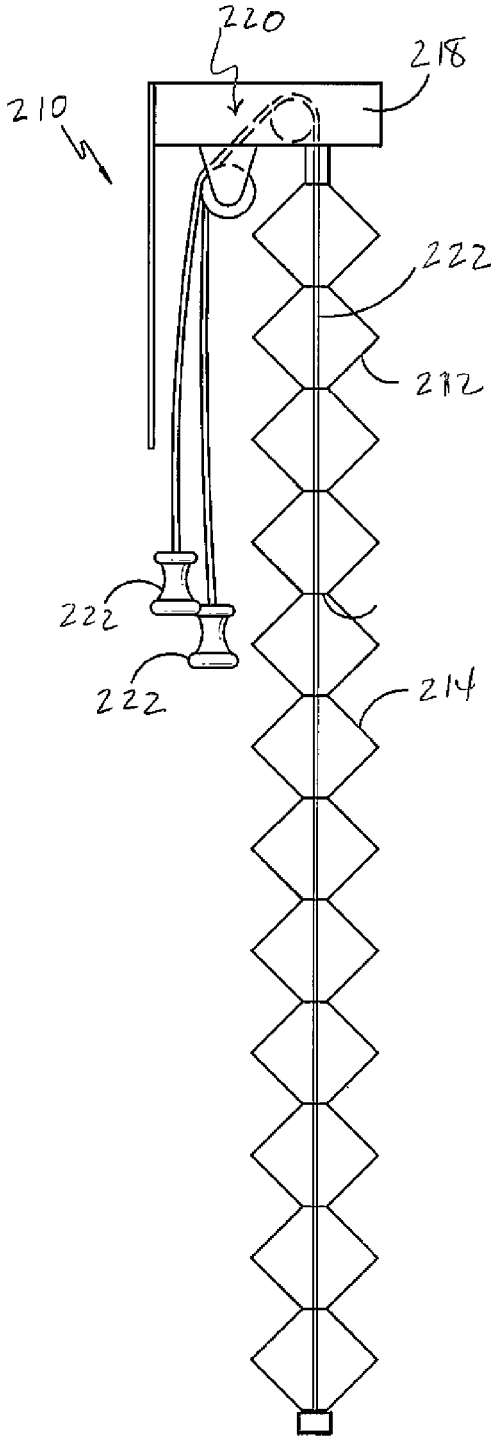
FIG. 6 is a side view of another alternative embodiment of a shade product made in accordance with the present disclosure.
Figure 7:
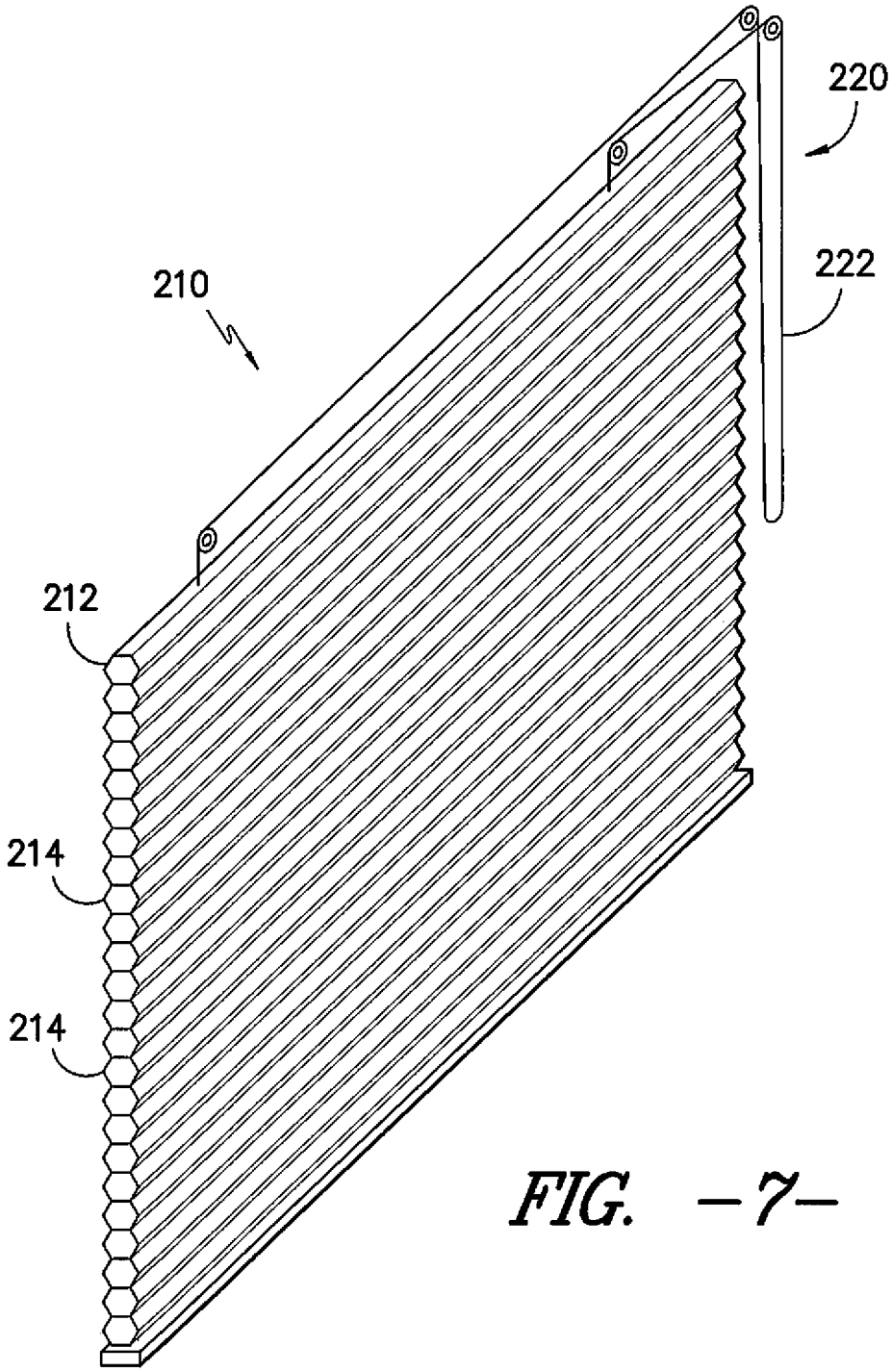
FIG. 7 is a perspective view of the embodiment illustrated in FIG. 6 absent the head rail assembly.

Referring now to FIGS. 6 and 7, still another embodiment of a shade product 210 made in accordance with the present disclosure is shown. The shade product 210 illustrated in FIG. 6 is generally referred to as a cellular shade. In particular, the shade product 210 includes a fabric panel 212 that is comprised of individual cells 214. In the embodiment illustrated, the cells 214 have a hexagonal shape. The cells are attached together in a sequential manner. The cells are also collapsible such that when the shade is retracted, the cells collapse and form a stack.

In order to extend and retract the fabric panel 214, the shade product 210 includes a control mechanism 220 that includes at least one drawstring 222. The shade product 210 can also be associated with a head rail 218 for mounting the shade product into an architectural opening and for enclosing the control mechanism 220.

In accordance with the present disclosure, in one embodiment, it may be desirable to construct the fabric panel 212 and the individual cells 214 from a sheer material. The sheer material, for instance, may have an open weave construction or an open knit or open non-woven or may comprise an apertured material in order to allow significant amounts of light to pass through the shade for not only providing light to an interior room, but for also creating a desired atmosphere within the room. In order to produce the individual cells 214, and in order to attach the cells together, the sheer material is attached or connected to itself. For instance, referring to FIG. 8, each individual cell 214 is made from a fabric section 238 that can comprise a sheer material. Each fabric section 238 includes a front crease 230 and a back crease 232 which allows the cells 214 to collapse when the fabric panel is retracted.

In accordance with the present disclosure, each fabric section 238 includes three areas where an adhesive receptive coating 240 is applied. In particular, adhesive receptive coatings are placed at each end of each fabric section and are placed in the middle of each fabric section. The ends of one fabric section are then bonded to the middle of an adjacent fabric section for creating a sequential series of cells. In particular, the cells 214 are attached together through the use of an adhesive 242 that is positioned in between the adhesive receptive coatings 240. In the embodiment illustrated, for instance, two adhesive beads are applied along the width of the fabric panel in two separate locations.

It should be understood that the embodiment illustrated in FIG. 7 represents only one way in which a cellular shade product can be constructed. It should be understood that the adhesive receptive coating of the present disclosure may be used in any manner of assembling together a cellular shade. Other methods for constructing cellular shades, for instance, are described in U.S. Pat. Nos. 6,767,615; 4,861,404; 4,677,012; 5,701,940; 5,691,031; 4,603,072; 4,732,630; 4,388,354; 5,228,936; 5,339,882; 6,068,039; 6,033,504; and 5,753,338, which are all incorporated herein by reference.

For example, in other embodiments, a cellular shade may be produced from two sheets of material which are pleated and then glued at the apex of the folds to form the cells. In an alternative embodiment, cellular shades can be produced by joining together multiple flat sheets of material along alternating glue lines between each flat sheet. In still another embodiment, a cellular shade can be produced by attaching a series of slats between two adjacent spaced apart sheets of material. In accordance with the present disclosure, one or more adhesive receptive coatings can be incorporated into the products where the different materials are attached together.

Figure 8:
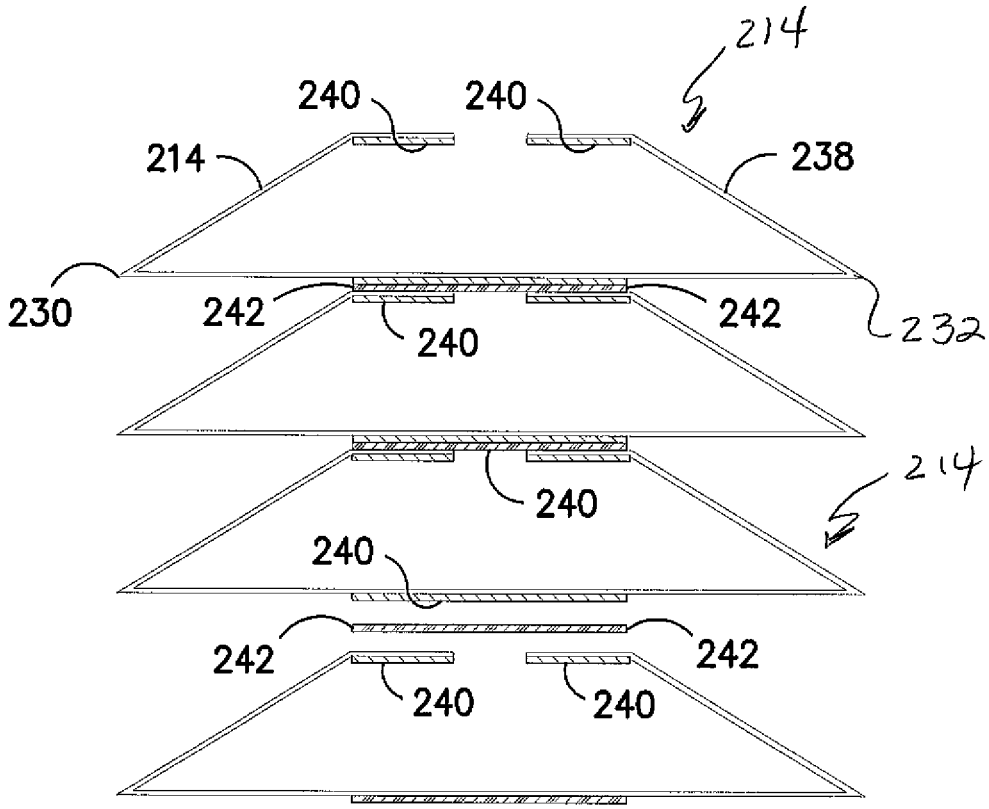
FIG. 8 is a partial cross-sectional exploded view of the shade product illustrated in FIGS. 6 and 7.

In the embodiment illustrated in FIGS. 6, 7 and 8, a cellular shade is illustrated that includes a single column of cell structures. It should be understood, however, that cellular shades made with multiple columns of cellular structures attached together can also be made in accordance with the present disclosure. For instance, cellular shades can be constructed having a double celled structure or a triple celled structure. Such products can include tabs or can be produced without any tabs.

Referring to FIGS. 9 and 10, still another embodiment of a shade product 310 made in accordance with the present disclosure is shown. In the embodiment illustrated in FIGS. 9 and 10, the shade product is in the form of a Roman shade. In FIG. 9, the shade product 310 is shown in an extended position, while in FIG. 10 the shade product is shown in a retracted position.

As shown in FIG. 9, the shade product 310 includes a front side 314 and a back side 316. The fabric product 310 is made from a plurality of fabric sections 338. In contrast to the embodiments shown above, in this embodiment, each fabric section 38 does not include a crease or fold line approximately in the middle of the length of each fabric section.

In accordance with the present disclosure, each end of each fabric section 338 includes an adhesive receptive coating 340. The adhesive receptive coating 340 is in the shape of a continuous strip that extends substantially the entire width of the fabric section 338. An adhesive 342 is placed inbetween the coatings for forming the tabs 334. As shown, the drawstring 322 intersects each of the tabs 334.

Through the use of the tabs 334, the fabric sections 338 are attached together sequentially forming open cells along the length of the product. As shown in FIG. 10, when the drawstring 322 is retracted, the open cells collapse wherein the fabric sections 338 billow outwards along the front face of the product. In the embodiment illustrated in FIG. 10, the billowing sections overlap with each other and extend downwardly which can provide the product with an attractive aesthetic appearance when retracted.

The use of the adhesive receptive coatings 340 allows for the shade product 310 to be made from a sheer material or other porous fabric. It should be understood, however, that the shade construction shown in FIGS. 9 and 10 can be used with any suitable material to form the fabric sections 338.

In the embodiment illustrated in FIGS. 9 and 10, as described above, the fabric sections 338 form open cells. Alternatively, a backing layer, such as a backing fabric may be attached along the back face of the product to form closed cells. In this manner, the drawstring 322 would be encased within the cells. When placing a backing layer on the product, the backing layer may include creases such that the backing layer folds into a stack when the product is retracted.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A vertically expandable and collapsible shade capable of being raised and lowered comprising:

a fabric panel comprised of a sheer material defining a plurality of interstitial openings, the fabric panel including at least one bond site where the sheer material has been bonded to an adjacent material, the sheer material at each bond site including an adhesive receptive coating, the adhesive respective coating comprising a continuous polymer coating that blocks the plurality of interstitial openings defined by the sheer material and prevents an adhesive from migrating through the sheer material;

an adhesive located at the bond site that adheres the sheer material to the adjacent material; and a mechanism for vertically raising and lowering the fabric panel;

wherein the adjacent material defines a first side facing the sheer material at the bond site and a second and opposite side, and wherein the adjacent material includes a second adhesive receptive coating positioned at the bond site on the first side of the adjacent material, the second side of the adjacent material, or both.

2. A vertically expandable and collapsible shade as defined in claim 1, wherein the shade includes a back panel intended to face an architectural opening and a front panel and wherein the fabric panel comprised of the sheer material is the back panel.

3. A vertically expandable and collapsible shade as defined in claim 1, wherein the fabric panel comprises a plurality of consecutive cells made from the sheer material, the fabric panel including a plurality of bond sites, the bond sites being located between adjacent cells.

4. A vertically expandable and collapsible shade as defined in claim 1, wherein the sheer material is comprised of monofilament yarns.

5. A vertically expandable and collapsible shade as defined in claim 1, wherein the fabric panel comprises a plurality of fabric sections bonded together at the bond sites.

6. A vertically expandable and collapsible shade as defined in claim 5, wherein each fabric section defines a crease line.

7. A vertically expandable and collapsible shade as defined in claim 5, wherein each fabric section is free of crease lines inbetween the bond sites.

8. A vertically expandable and collapsible shade as defined in claim 1, wherein the adhesive receptive coating comprises a hot melt polymer.

9. A vertically expandable and collapsible shade as defined in claim 2, wherein the hot melt polymer comprises a polyester.

10. A vertically expandable and collapsible shade as defined in claim 2, wherein the hot melt polymer has a softening temperature of at least about 170° C.

11. A vertically expandable and collapsible shade as defined in claim 2, wherein the hot melt polymer exhibits a substantially white color and is applied to a sheer material that also has a substantially white color.

12. A vertically expandable and collapsible shade as defined in claim 1, wherein the adhesive receptive coating is substantially transparent.

13. A vertically expandable and collapsible shade as defined in claim 1, wherein the adhesive receptive coating has a color that is substantially the same color as the fabric panel.

14. A vertically expandable and collapsible shade as defined in claim 1, wherein the at least one bond site comprises a site where two pieces of the sheer material are bonded together.

15. A vertically expandable and collapsible shade as defined in claim 1, wherein the adhesive receptive coating comprises a UV cured polymer.

16. A vertically expandable and collapsible shade as defined in claim 15, wherein the UV cured polymer comprises an epoxy-acrylic resin.

17. A vertically expandable and collapsible shade as defined in claim 15, wherein the UV cured polymer comprises a varnish.

18. A vertically expandable and collapsible shade as defined in claim 1, wherein the sheer material includes a plurality of parallel crease lines, the bond sites extending along certain of the crease lines where two layers of the sheer material are attached together by the adhesive to form tabs, the adhesive receptive coating comprising strips extending parallel to a corresponding crease line, the strips being located on opposing layers of the sheer material where the bond sites are located such that the adhesive is located between the two opposing strips.

19. A vertically expandable and collapsible shade as defined in claim 18, wherein the at least one bond site comprises a site where two pieces of the sheer material are bonded together.

20. A vertically expandable and collapsible shade as defined in claim 18, wherein the fabric has a length and a width and wherein the crease lines extend over the entire width of the fabric panel.

21. A vertically expandable and collapsible shade as defined in claim 18, wherein the mechanism for vertically raising and lowering the fabric panel comprises a drawstring and wherein the drawstring intersects the tabs.

22. A vertically expandable and collapsible shade as defined in claim 18, wherein the mechanism for vertically raising and lowering the fabric panel comprises a drawstring and wherein the drawstring intersects the sheer material between adjacent crease lines.

23. A vertically expandable and collapsible shade as defined in claim 18, wherein adjacent crease lines extend in opposite directions to form an accordion-like configuration.

24. A vertically expandable and collapsible shade as defined in claim 23, wherein the shade includes a first side configured to face an architectural opening and a second and opposite side and wherein the tabs extend towards the first side.

25. A vertically expandable and collapsible shade as defined in claim 23, wherein the shade includes a first side configured to face an architectural opening and a second and opposite side and wherein the tabs extend towards the second side.

* * * * *